United States Patent [19]

Soum

[11] 4,274,240

[45] Jun. 23, 1981

[54] CONCRETE FLOOR SLAB CONSTRUCTED FROM BASIC PREFABRICATED SLABS

[76] Inventor: René Soum, 2 rue Jolimont, 31500 Toulouse, France

[21] Appl. No.: 35,620

[22] Filed: May 3, 1979

[30] Foreign Application Priority Data

Jul. 18, 1978 [FR] France ..... 78 21636

[51] Int. Cl.[3] ..... E04C 1/24

[52] U.S. Cl. ..... 52/583; 52/587

[58] Field of Search ..... 52/583, 587, DIG. 10, 52/582, 578, 581

[56] References Cited

U.S. PATENT DOCUMENTS

| | | | |
|---|---|---|---|
| 2,921,462 | 1/1960 | Wilson | 52/583 X |
| 3,386,252 | 6/1968 | Nelson | 52/583 X |
| 3,722,160 | 3/1973 | Bentley | 52/583 X |
| 3,898,777 | 8/1975 | Georgiev et al. | 52/583 |
| 3,951,085 | 4/1976 | Johnson et al. | 52/587 X |

*Primary Examiner*—J. Karl Bell

*Attorney, Agent, or Firm*—Shlesinger, Arkwright, Garvey and Dinsmore

[57] ABSTRACT

A concrete floor slab constructed from several basic prefabricated slabs. This slab comprises at least three basic slabs 1, 2 and 3 of polygonal shape, set together and arranged around a central point, with at least three anchoring units located at the central point each at least partially embedded in a basic slab, a central junction component located at the central point between the basic slabs and mechanical assembly methods for the central junction component linking it with the anchoring units.

The invention applies to the construction of all types of load bearing floors and in particular those of wide span which rest directly on pillars without the intermediate use of joists.

4 Claims, 7 Drawing Figures

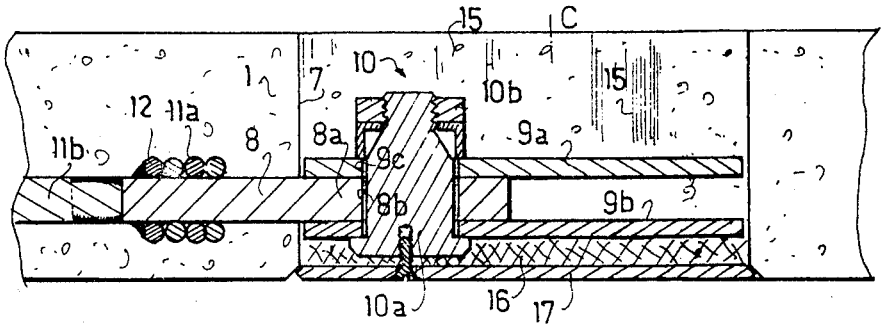
Fig. 3
Fig. 4
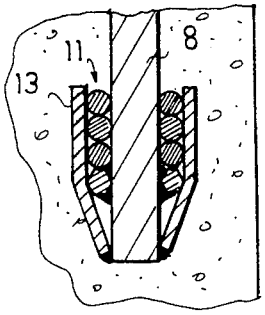
Fig. 5
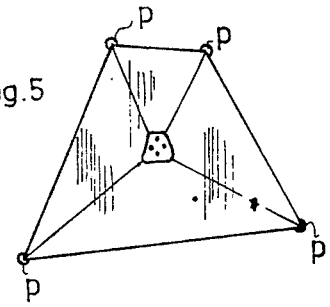
Fig 6
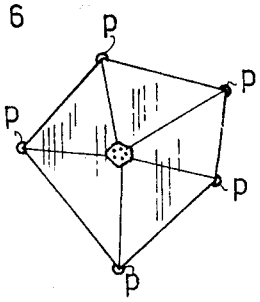
Fig. 7
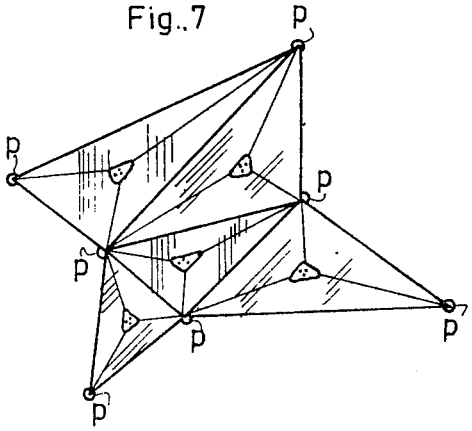

CONCRETE FLOOR SLAB CONSTRUCTED FROM BASIC PREFABRICATED SLABS

The invention relates to concrete floor slabs made up from several basic prefabricated slab units; it relates to the production of all types of load bearing floors and in particular enables wide span floors to rest directly on pillars without intermediate beams.

It is well known that to construct concrete floors it is necessary to prefabricate slabs in a factory production unit and to assemble them on the work site; because of transport limitations, these factory-produced slabs are relatively restricted in width and during assembly it is therefore necessary to set their edges on bearer beams or walls.

So at the present time there is no system available for the construction of large-size slabs from basic prefabricated slabbing which can be transported without having recourse to the use of beams or walls to support each of the basic slabs.

This invention is designed to remedy this deficiency.

One object of the invention is in particular to enable basic prefabricated slabs to be assembled without recourse to beams which has the special advantage of enabling flat ceilings to be constructed.

Another object is to enable large size slabs to be constructed from basic prefabricated slabs, themselves readily transportable and supported on pillars.

For this purpose, the floor slab constructed in accordance with the principles of the invention comprises basically:

at least three basic prefabricated slabs of concrete and of polygonal shape so that they can be joined together in pairs around a central point in accordance with the assembly plans which converge upon this central point, at least three anchorages located near the central point, each at least partially embedded into the basic slab in such a manner as to be anchored into the concrete of the said basic slab, a central assembly unit located at the central point to join the basic slabs, and mechanical assembly methods to join the central assembly unit with the anchorages.

Figure 1:
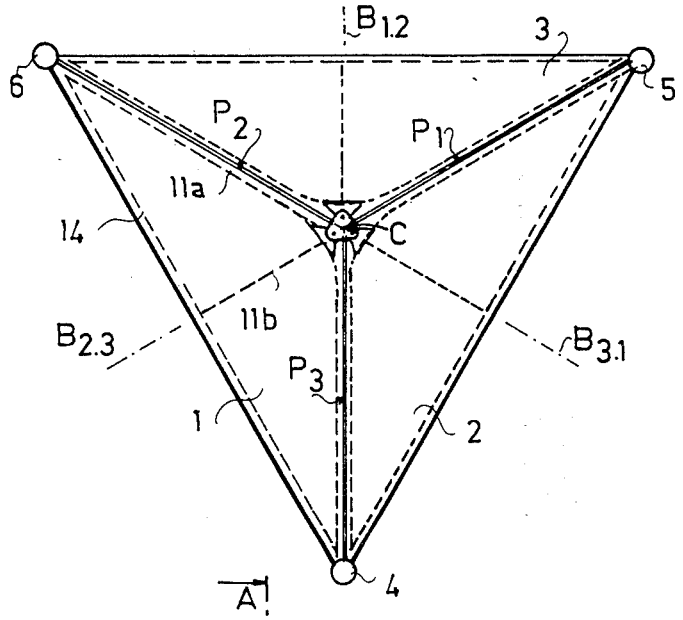
Figure 2:
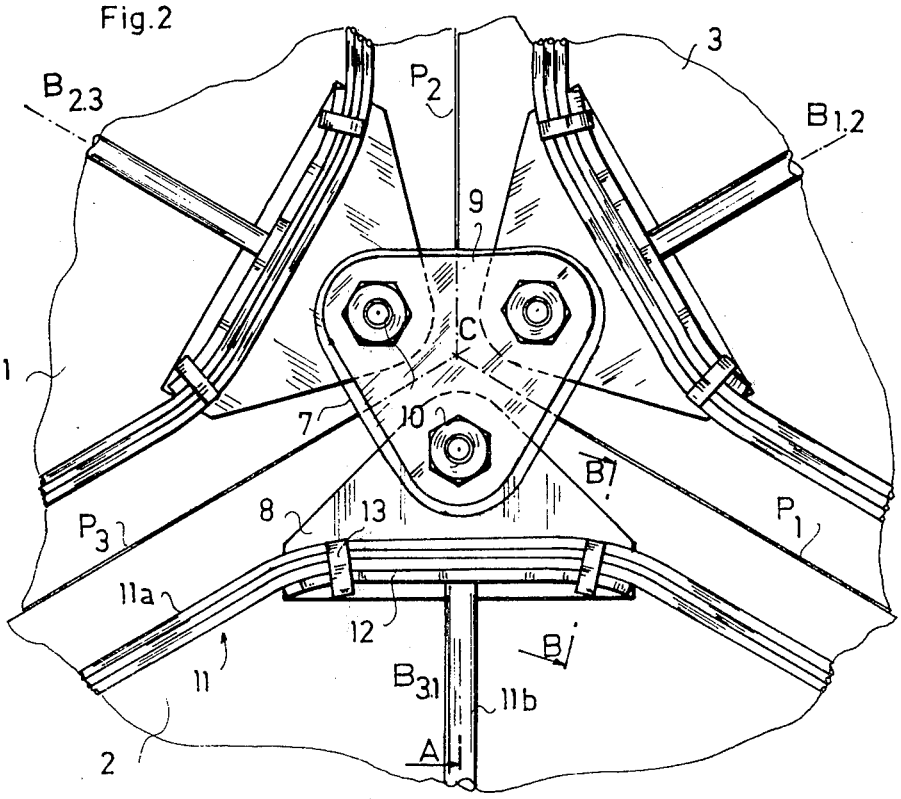

Other characteristics, objects and advantages of the invention will become evident from the following description in conjunction with the drawings attached and which show as a non-comprehensive series of examples methods of slab construction and variants on these drawings:

FIG. 1 is a diagrammatic plan view of a slab constructed in accordance with the invention, FIG. 2 is a detailed view of the center of the slab in which the concrete has been made to appear transparent, FIG. 3 is a vertical section AA of the said slab, FIG. 4 is a detailed section through a vertical plane BB, FIG. 5, 6 and 7 show in plan, diagrams of the construction of other slabs in accordance with the principles of the invention.

The slab shown as an example at FIGS. 1, 2, 3 and 4 is constructed from three basic concrete slabs 1, 2 and 3 which in this particular example have a general shape of three isoceles triangles. Each basic slab is prefabricated at the factory and its dimensions are such as to render it easily transportable.

The three slabs 1, 2 and 3 are arranged in a circle around a central point C so that their sides are adjacent and joined at points $P_1$, $P_2$ and $P_3$; these junction lines converge to the central point C passing through the center lines of the pillars 4, 5 and 6 on which the two tops of each basic slab will bear as shown in FIG. 1; the anchorage of these tops to the pillars is made in a standard manner. The third top (fictitious) of each slab coincides with the central point C.

In the neighbourhood of this central point, the basic slabs are fitted with notches as shown at 7 which form a central seating. These basics slabs are joined solidly together at this central point by means of anchorage units as shown at 8 partially embedded in each slab, and by means of a central assembly component 9 located between the slabs in the above-mentioned seating, and mechanical assembly methods such as those shown at 10 enabling the central junction component 9 and the anchorage parts 8 to be fitted together.

In the example, each anchorage section 8 is formed by an anchor plate partially embedded in the corresponding basic slab and equipped with a section **8*a* which protrudes from the notch of the said basic slab; this part 8*a* has an aperture 8*b*** which crosses the plate.

Furthermore, each anchoring unit is linked to a system of reinforcements 11 which are disposed within the basic slab in order to distribute in the latter the forces received by the said anchoring unit.

This system comprises basically reinforcements as shown at **11*a* which are distributed within the slab along a line which is approximately parallel to the joining points, $P_1$, $P_2$ or $P_3$ of the latter. These reinforcements 11*a* are formed in particular of prestressed concrete wires. They bear against the anchoring plate which for this purpose is equipped with projecting edges 12 and side holding lugs 13**.

Other reinforcement units such as iron rods **11*b* welded to each anchorage part or prestressed cable 14** may as necessary be fitted within the basic slabs to provide a suitable distribution of the forces set up.

Furthermore, the central joining unit 9 is in the example formed by two junction plates **9*a* and 9*b*, one applied to one face of the projecting parts 8*a* of the anchoring plates and the other applied to the opposite face of the latter; these junction plates are fitted with apertures 9*c* which mate with each of the apertures 8*b*** in the anchoring plates.

Finally, the mechanical assembly methods 10 are in the example formed of pins **10*a* which are inserted in the aligned holes 8*b* and 9*c* of the anchoring plates and junction plates respectively and fitted with lock nuts 10*b***.

After assembly of the basic slabs, filling concrete 15 is poured above the central junction component 9 in the housing formed by the notches in the slabs, up to the level of the upper face of the latter. Furthermore, an insulation covering 16 (glass wool or other) and a rendering 17 (fibro-cement panel or other) is fixed at the lower section of this housing to provide for the continuity of the ceiling.

In this manner is obtained a stable slab of large size supported by pillars $P_1$, $P_2$ and $P_3$ in the absence of a beam or wall and of a density and spread of completely conventional type; this slab is constructed from prefabricated basic slabs of suitable size for transport.

It should be noted that as is shown in the diagrams, the anchorage parts 8 and mechanical assembly methods 10 are, in respect of each basic slab, arranged symmetrically in relation to plane $B_{12}$, $B_{23}$ or $B_{31}$ along the bisecting line of junction planes $P_1$, $P_2$ or $P_3$; thus is obtained a highly satisfactory distribution of forces and the mechanical assembly methods 10 are used to transmit the traction forces located along these bisecting lines between the junction component 9 and the anchorage units 8.

As shown in FIGS. 5 and 6, the invention is applicable to all forms of ceiling constructed of slabbing which rests directly on pillars (marked P on the diagrams).

FIG. 7 shows the construction of a slab using a triangular frame.

In each case, each basic prefabricated slab is very much smaller in plan than the framing between the pillars.

I claim:

1. A concrete floor slab adapted to be supported on pillars or the like comprising:

(a) at least three basic prefabricated concrete slabs having triangular shapes and arranged around and encircling a central point, (b) said basic slabs being arranged such that adjacent sides of adjacent basic slabs lie along lines converging at said central point, (c) each of said basic slabs having an apex coinciding with said central point and two apices supported on pillars, (d) at least three anchoring members arranged adjacent said central point, each of said anchoring members being at least partially embedded in one of said basic slabs in such a manner as to be anchored in the concrete of the respective basic slab, (e) a central joining unit situated at said central point between said basic slabs, (f) means for connecting each of said anchoring members to said central joining unit, (g) said anchoring members and said connecting means being arranged symmetrically for each slab about a line bisecting the angle between the adjacent sides of each slab for distributing forces on said basic slab about the line of symmetry, (h) each of said anchoring members including reinforcement means extending into adjacent sides of the corresponding basic slab symmetrically about said line for distributing forces exerted on said anchoring means to said basic slab.

2. A floor slab as in claim 1 and wherein said reinforcement means is embedded in said basic slabs and extends parallel to adjacent coverging junction lines.

3. A floor slab as in claim 1 and wherein said basic slabs include notches for receiving a portion of said central joining unit, each of said anchoring members comprising an anchoring plate partially embedded in a basic slab and having a portion projecting toward said central point and having an aperture therein, said central joining unit comprising a pair of spaced parallel plates positioned on opposite sides of said anchoring plates and having apertures aligned with the apertures in said anchoring plates, and said connecting means comprising mechanical fastening members passing through said aligned apertures for connecting the basic slabs to said central joining unit.

4. A floor slab as in claim 3 and wherein said basic slabs form a recess around said central joining unit, and poured concrete filling said recess to the level of said floor slab.

* * * * *